US009336762B2

(12) United States Patent
Hlatky et al.

(10) Patent No.: US 9,336,762 B2
(45) Date of Patent: May 10, 2016

(54) ELECTRONIC MUSIC INSTRUMENT WITH TOUCH-SENSITIVE MEANS

(71) Applicant: NATIVE INSTRUMENTS GmbH, Berlin (DE)

(72) Inventors: Michael Hlatky, Berlin (DE); Josef Rissling, Berlin (DE); Dinos Vallianatos, Berlin (DE)

(73) Assignee: NATIVE INSTRUMENTS GMBH, Berlin (DE)

( * ) Notice: Subject to any disclaimer, the term of this patent is extended or adjusted under 35 U.S.C. 154(b) by 0 days.

(21) Appl. No.: 14/474,574

(22) Filed: Sep. 2, 2014

(65) Prior Publication Data

US 2016/0063977 A1 Mar. 3, 2016

(51) Int. Cl.
*G10H 1/18* (2006.01)
*G10H 1/34* (2006.01)

(52) U.S. Cl.
CPC . *G10H 1/18* (2013.01); *G10H 1/34* (2013.01); *G10H 2220/275* (2013.01)

(58) Field of Classification Search
CPC ..... G10H 1/18
USPC ..... 84/615, 653
See application file for complete search history.

(56) References Cited

U.S. PATENT DOCUMENTS 4,453,439 A * 6/1984 Koike ..... 84/653
5,247,261 A * 9/1993 Gershenfeld ..... 324/716
5,459,280 A * 10/1995 Masuda et al. ..... 84/622
5,471,007 A * 11/1995 Van Duyne et al. ..... 84/622
5,500,486 A * 3/1996 Smith, III ..... 84/622
6,066,794 A * 5/2000 Longo ..... 84/626
RE37,654 E * 4/2002 Longo ..... 84/626
2004/0267539 A1* 12/2004 Wu ..... 704/278
2005/0154569 A1* 7/2005 Sapp ..... 703/9
2006/0101983 A1* 5/2006 Boxer ..... 84/484
2007/0118241 A1* 5/2007 Rosenberg ..... 700/94
2007/0198926 A1* 8/2007 Joguet et al. ..... 715/702
2008/0034946 A1* 2/2008 Aimi ..... 84/604
2014/0007755 A1* 1/2014 Henriques ..... 84/723
2014/0083279 A1* 3/2014 Little et al. ..... 84/609

* cited by examiner

*Primary Examiner* — David Warren
(74) *Attorney, Agent, or Firm* — Fox Rothschild LLP

(57) ABSTRACT

An electronic music instrument is provided comprising at least one input element configured to trigger an output sound signal when pressed. The electronic music instrument further comprises a controlling device adapted to alter at least one parameter of at least one output sound signal triggered with the at least one input element. Furthermore, the electronic music instrument comprises a housing adapted to house the at least one input element and the controlling device. The controlling device comprises at least one touch-sensitive means wherein the parameter of the at least one output sound signal is altered corresponding to the position of at least one marker. The controlling device is adapted to set the position of the at least one marker by a simulation of a physical system, and wherein the state of the simulated physical system is alterable by a touching gesture on the at least one touch-sensitive means.

15 Claims, 4 Drawing Sheets

ELECTRONIC MUSIC INSTRUMENT WITH TOUCH-SENSITIVE MEANS

The field of the invention is directed to electronic music instruments, more particularly to control devices used within an electronic music instrument in order to change parameters of sound signals which can be triggered with at least one input element of the electronic music instrument.

An electronic music instrument is an electronic keyboard, an electronic piano, a pad-controller, a DJ console, a synthesizer, a 4×4-button-controller, a controlling device for music production or the like. For example electronic keyboards usually comprise a standard keybed with a plurality of keys, wherein each key is adapted to generate or trigger an output sound signal of a predefined characteristic when pressed. Many of such electronic keyboards additionally comprise a plurality of knobs, buttons and other control elements a user can use to adjust further parameters that influence the output signal of the instrument.

However, most electronic music instruments known to the state of the art have a limited set of functionalities which is not or only inessentially alterable by the user of the same. Especially the control of a pitch, of a modulation or of other such parameters which serve to influence output sound signals generated or triggered with input elements of such electronic music instruments are often restricted to common hardware and software which is not alterable or adjustable by a user.

Therefore, a technical problem to be solved by the invention is to provide an electronic music instrument with a control element that enables different and interchangeable functionalities and modes for an alteration of substantial parameters of output sound signals triggered with at least one input element of the electronic music instrument.

SUMMARY OF THE INVENTION

In one aspect of the invention, an electronic music instrument is provided comprising at least one input element configured to trigger an output sound signal when pressed, a controlling device comprising at least one touch-sensitive means, and a housing adapted to house the at least one input element and the controlling device. The controlling device is adapted to alter at least one parameter of at least one output sound signal triggered with the at least one input element corresponding to a marker. The controlling device is further adapted to set the position or value of the at least one marker by a simulation of a physical system, and the state of the simulated physical system is alterable by a touching gesture on the at least one touch-sensitive means An advantage of such an electronic music instrument is that the controlling device, e.g. comprising a touchpad, enables an easy and flexible alteration of substantial parameters of output sound signals that can be triggered with the at least one input element. Moreover, with such a touch-sensitive means, it is easily possible to change the functionality and the mode of operation of the same, since a user can assign the at least one touch-sensitive means with a plurality of different modes of parameter control and is not restricted to for example the mechanics of a given hardware. Furthermore, via a simulation of a physical system or more specifically of the kinematics of a physical system, a user of the electronic music instrument is able to intuitively handle the controlling device. Different physical systems can be pre-stored and thus predefined in the electronic music instrument and can be selected by the user.

Throughout the invention, a simulation of a physical system is to be understood as the simulation of the kinematics or physics or behaviour of a physical system. For instance, the physical system may be a spring and the touch-sensitive means is adapted to simulate the motion or movement of the spring.

In a preferred embodiment, the electronic music instrument is an integrated electronic keyboard system, an electronic piano, a pad-controller, a DJ console, a synthesizer, a matrix controller, a matrix button controller, a 4×4-button-controller, or a controlling device for music production.

Preferably, the at least one input element is at least one key, at least one button, at least one knob or at least one pad.

In another embodiment, the output sound signals may be pre-stored in the electronic music instrument.

In another embodiment, the at least one input element is configured to generate an output sound signal when pressed.

Preferably, the electronic music instrument comprises at least two input elements. The at least two input elements are arranged in a common functional group. Preferably, the at least two input elements are arranged and/or mapped in a chromatic sequence or scale. In a preferred embodiment of the invention, the parameter is at least one out of the group comprising the pitch and the modulation of the at least one output sound signal. In such an embodiment of the invention, the control of the pitch and/or the modulation is not limited to a given hardware which predefines the direction and the amount of the alteration of the pitch and/or the modulation of an output sound signal as is done for example by a standard pitch and modulation wheel control usually to be found on for example comparable MIDI keyboards. In contrary, the embodiment according to the invention allows to vary the mode and functionality in which the pitch and/or the modulation of an output sound signal is altered, using the at least one touch-sensitive means.

Furthermore preferred, the touch-sensitive means is planar and is physical. Preferably, the at least one touch-sensitive means comprises a sensor which is adapted to sense a touching gesture of a user. Preferably, the at least one touch-sensitive means is a pointing device comprising a tactile sensor with a specialized surface that is adapted to translate the motion and position of a user's touching gesture to a relative position on an operating system that outputs a corresponding signal. Preferably, the at least one touch-sensitive means is at least one touch pad or at least one track pad. In such an embodiment, the at least one touch-sensitive means can easily be integrated into the housing of the electronic music instrument.

Preferably, the touch-sensitive means is realized as at least one touchstrip. Furthermore preferred the touch-sensitive means comprises at least two separate touchstrips which are arranged adjacent towards one another. Moreover preferred, a first of the at least two separate touchstrips is adapted to alter the pitch of at least one output sound signal triggered with the at least one input element, wherein the second of the at least two separate touchstrips is adapted to alter the modulation of at least one output sound signal triggered with the at least one input element. Preferably, different parameters of output sound signals are separately alterable in their amount and their direction with the at least two separate touchstrips respectively. Furthermore preferred, a first of the at least two separate touchstrips is adapted to alter a first predefined parameter of at least one output sound signal triggered with the at least one input element, wherein the second of the at least two separate touchstrips is adapted to alter a second predefined parameter of at least one output sound signal triggered with the at least one input element. Preferably, the first and the second predefined parameter are different from the pitch and the modulation of the at least one output sound signal respectively. Such touchstrips enable a precise definition and alteration of the value of the at least one parameter. Moreover, since no physical systems come to use within the touchstrip, the endurance and lifetime of the touch-sensitive means is increased in comparison to controlling devices which are based on physical systems.

In a preferred embodiment, light emitting diodes are arranged adjacent to the at least one touch-sensitive means, adapted to indicate the amount and the direction of an alteration of the at least one parameter of the at least one output sound signal. In such an embodiment, the user of the at least one touch-sensitive means advantageously receives a visual feedback for every alteration of a parameter of an output sound signal. Expressed in other words, the light emitting diodes or LEDs positioned next to the at least one touch-sensitive means, e. g. next to the touchstrips, always provide the user with a visual feedback of the current amount and direction of an alteration of a parameter.

In a preferred embodiment, a plurality of different instruments is playable with the at least one input element of the electronic music instrument. Furthermore preferred, the at least one input element of the electronic music instrument is adapted to play a plurality of different instruments, wherein the user can vary the instrument to be played. Preferably, the functioning and behaviour of the at least one touch-sensitive means is changeable in the context of the instrument played.

Preferably, the at least one touch-sensitive means is adapted to simulate a mechanical parameter control unit. In such an embodiment, the kinematics of mechanical control units as for example of pitch control units as used in electronic keyboards of the state of the art is transferred to the controlling device of the electronic music instrument according to the invention. In such an embodiment, a user of the electronic music instrument according to the invention does not have to change his or her habits regarding a parameter control of output sound signals, even though he or she can nevertheless change the functionality and behaviour of the at least one touch-sensitive means.

In a preferred embodiment, light emitting diodes are arranged adjacent to the at least one touch-sensitive means, adapted to provide a visual feedback of an instant state of the simulated mechanical parameter control unit. Such an arrangement of light emitting diodes helps to handle and follow the alteration of the at least one parameter of the at least one output sound signal.

Preferably the touch-sensitive means is operable in different modes of operation. In such an embodiment, a user can chose between different functionalities, behaviours, operating schemes and patterns which are assignable or mappable to the at least one touch-sensitive means.

In a first embodiment, the physical system is a spring system comprising at least one spring. The touch-sensitive means provides here an intuitive handling of the controlling device, which enables the simulation of the kinematics of a spring system.

In a preferred embodiment, the flexibility of the at least one spring is variable. In such an embodiment, a user can advantageously adjust the reaction of the at least one touch-sensitive means to an actuation of the same, thereby varying the amount of time needed to change its position upon release of the at least one touch-sensitive means.

Preferably the at least one touch-sensitive means is adapted to trace a sliding gesture along the at least one touch-sensitive means. In such an embodiment, the at least one touch-sensitive means is capable to linearly change the at least one parameter of the output sound signal and to alter the at least one parameter of the output sound signal according to the traced sliding gesture.

Furthermore preferred, the controlling device together with the at least one touch-sensitive means are adapted to continuously alter the at least one parameter of the at least one output sound signal. With such an embodiment, it is for example possible to fluently alter the at least one parameter of the output sound signal according to an inputted sliding gesture.

In a preferred embodiment of the invention, the at least one marker is adapted to spring back into a predefinable center position of the at least one touch-sensitive means upon release of the at least one touch-sensitive means. Furthermore preferred, the at least one marker is adapted to snap back into a predefinable center position of the at least one touch-sensitive means upon release of the at least one touch-sensitive means. In such an embodiment, the handling of the at least one touch-sensitive means is eased and the behaviour and functionality of the same is further approximated to the behaviour and functionality of a spring system. If a user of the at least one touch-sensitive means wants to transfer the same back into a predefined default position, he or she simply has to release the at least one touch-sensitive means.

Moreover preferred, in another embodiment, the at least one touch-sensitive means is subdivided into a plurality of separate buttons, wherein each simulated button is adapted to cause a change in the at least one parameter when touched. In such an embodiment, each simulated button exemplarily can be assigned with a discrete amount of alteration of the at least one parameter of an output sound signal, enabling a stepped alteration of the same.

Preferably, light emitting diodes are arranged adjacent to the at least one touch-sensitive means, adapted to provide a visual feedback when a simulated button is touched. In such an embodiment, the user is always informed whether a simulated button is in a touched or in a pressed state, which ameliorates the handling of a parameter alteration.

In yet another embodiment, the physical system is a ball bouncing between at least two predefinable borderlines on the at least one touch-sensitive means, wherein the at least one marker alters its position according to the simulated ball. Preferably, the at least two predefinable borderlines are determined by one end of the at least one touch-sensitive means respectively. In such an embodiment, the user of the electronic music instrument is provided with a directly touch-controllable low or high frequency oscillator. Preferably, this directly touch-controllable low or high frequency oscillator can be mapped to different predefined parameters, for example to the predefined parameters of an instrument that is playable with the at least one input element. Preferably, a user can virtually throw the ball with a corresponding touch gesture on the at least one touch-sensitive means.

Preferably, in another mode of operation, the physical system is a ball moving between at least two portals which are simulated in predefinable positions on the at least one touch-sensitive means. In such an embodiment, when the simulated ball is moving into a simulated portal, it disappears in that simulated portal and reappears in another portal simulated in another position on the at least one touch-sensitive means. With such an embodiment, an oscillation of a predefined parameter of at least one output sound signal can be provided, wherein the oscillation has a saw-tooth shaped or a triangular shaped waveform.

Preferably, light emitting diodes are arranged adjacent to the at least one touch-sensitive means, adapted to provide a visual feedback of a current position of the simulated ball. Expressed in other words, in a preferred embodiment, the current position of the simulated ball is indicated by the light emitting diodes. In such an embodiment, a user can easily interact with the simulated ball, thereby altering for example a frequency of its oscillation.

In a preferred embodiment, the inertia of the simulated ball is predefinable and variable. Furthermore preferred, the mass of the simulated ball is predefinable and variable. In such embodiments, the characteristic of the alteration of the at least one parameter of output sound signals can be influenced by a user, enabling the user to alter the pattern of the alteration of the output sound signals upon his or her wish.

Preferably, the light emitting diodes are adapted to emit light of more than one colour respectively. In a preferred embodiment of the invention, the light emitting diodes are adapted to emit light of a first colour and light of a second colour respectively, wherein the first colour is different from the second colour. Preferably, in the third mode of operation, light of the first colour of the light emitting diodes is used to indicate the position of the simulated ball, wherein light of the second colour of the light emitting diodes is used to indicate the position of the predefinable borderlines and/or of the simulated portals. Preferably, in the second mode of operation, light of the first colour of the light emitting diodes is used to indicate the width of a simulated button, wherein light of the second colour of the light emitting diodes is used to indicate a gap between the simulated buttons. Preferably, in a first mode of operation, light of the first colour of the light emitting diodes is used to indicate the position of the at least one marker, wherein light of the second colour of the light emitting diodes is used to indicate the predefinable center position.

The characteristics, features and advantages of this invention and the manner in which they are obtained as described above, will become more apparent and be more clearly understood in connection with the following description of exemplary embodiments, which are explained with reference to the accompanied drawings.

BRIEF DESCRIPTION OF THE DRAWINGS

The drawings show in

DETAILED DESCRIPTION OF THE DRAWINGS

Figure 1:
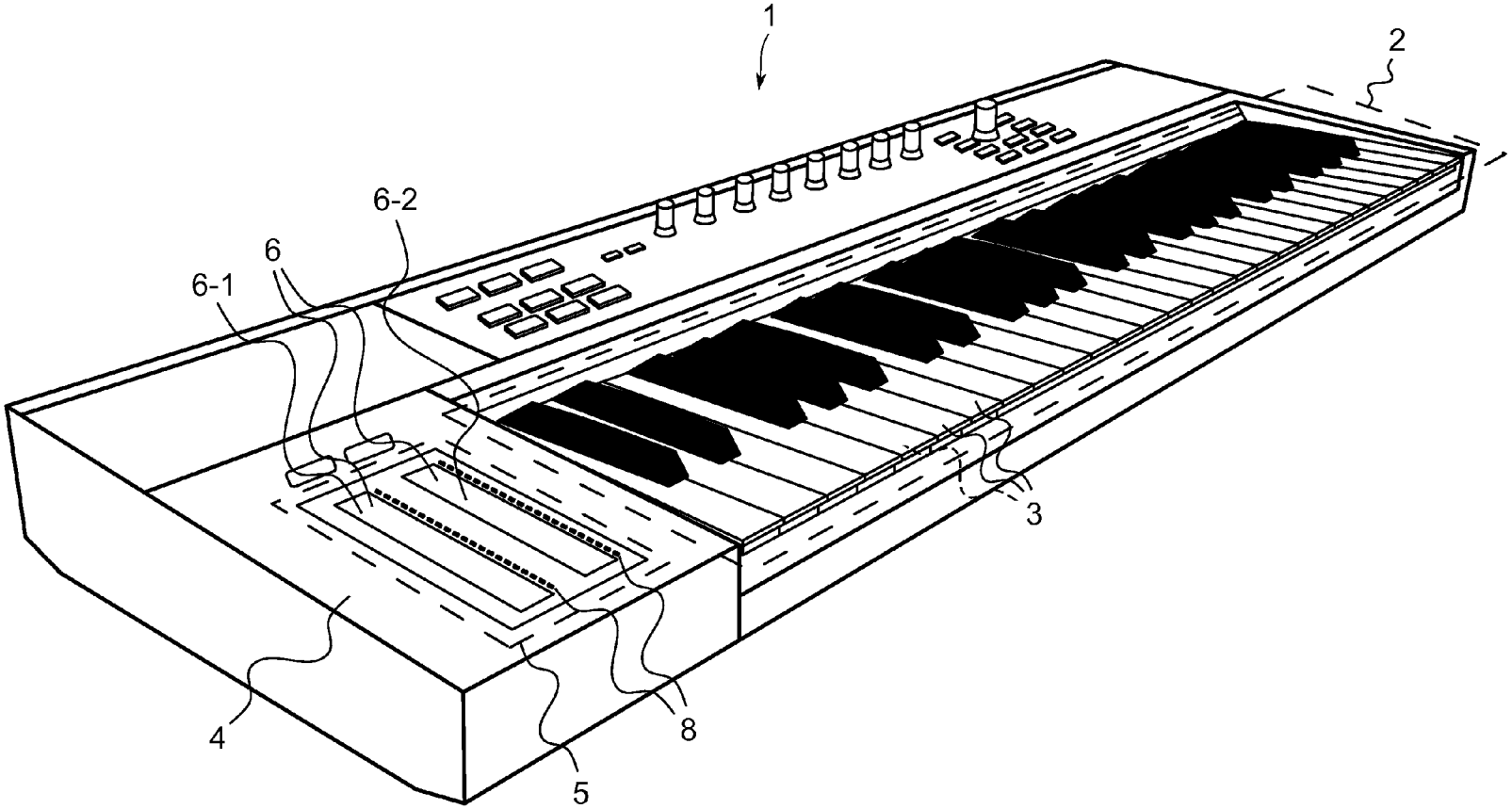
FIG. 1 a first embodiment of an electronic music instrument according to the invention, FIG. 2*a*-2*c* a schematic illustration of the functionality of the first touchstrip of the first embodiment of an electronic music instrument according to the invention in a first mode of operation, FIG. 3 a schematic illustration of the functionality of the first touchstrip of the first embodiment of an electronic music instrument according to the invention in a second mode of operation, and FIG. 4 a schematic illustration of the functionality of the first touchstrip of the first embodiment of an electronic music instrument according to the invention in a third mode of operation.

FIG. 1 shows a first embodiment of an electronic music instrument 1 according to the invention.

In this first embodiment of the invention, the electronic music instrument 1 is exemplarily realized as an integrated electronic keyboard system. However, the invention is not limited thereto and it is also possible to realize an electronic music instrument 1 according to the invention which is an electronic piano, a pad-controller, a DJ console, a synthesizer, a 4×4-button-controller, a controlling device for music production or the like. Furthermore, in this first embodiment of the invention, the input elements 3 are exemplarily realized as keys 3 of a keyboard 2. However, it is also possible to realize electronic music instruments 1 according to the invention which have pads, buttons, knobs or the like as input elements 3.

In this first embodiment of the invention, the electronic music instrument 1 comprises a keyboard 2 which comprises a multitude of keys 3, wherein each key 3 is configured to trigger an output sound signal when pressed and serves as an input element 3. In this first embodiment of the invention, the keyboard 2 exemplarily is equal to a standard electronic piano keybed. The electronic music instrument 1 further comprises a housing 4 which is adapted to house the keyboard 2 with the keys 3. Moreover in this first embodiment of the invention, the electronic music instrument 1 comprises a controlling device 5 adapted to alter two parameters of the output sound signals which can be triggered with the keys 3 of the keyboard 2. The housing 4 is also adapted to house the controlling device 5. Expressed in other words, the controlling device 5 is adapted to vary or change two different parameters of the output sound signals which can be triggered with the input elements 3, the keys 3 of the keyboard 2 respectively and is arranged within the housing 4. The controlling device 5 is fixed within the housing 4. However, the invention is not limited thereto and it is also possible to realize electronic music instruments 1 according to the invention with controlling devices 5 which are adapted to alter, vary or change only one or more than two parameters of output sound signals which can be triggered with the input elements 3. Furthermore, it is also possible to realize electronic music instruments 1 according to the invention with controlling devices 5 which are adapted to alter, vary or change parameters of certain output sound signals which can be triggered with only some of the input elements 3, wherein the output sound signals triggered with the remaining input elements 2 remain unchanged upon an actuation of the controlling device 5. For example, it is possible to realize electronic music instruments 1 according to the invention with controlling devices 5 which are adapted to alter, vary or change parameters of output sound signals of only one predefined octave, wherein output sound signals which are triggered with input elements 3 which are not belonging to this predefined octave remain unchanged upon an actuation of the controlling device 5.

The controlling device 5 comprises two touch-sensitive means 6, wherein the two parameters of the output sound signals are altered corresponding to the position of a marker which is set with a touching gesture on the touch-sensitive means 6 respectively. Expressed in other words, a first of the two parameters of the output sound signals can be altered via a first of the two touch-sensitive means 6, wherein the second of the two parameters of the output sound signals can be altered via the second of the two touch-sensitive means 6. In this first embodiment of the invention, the controlling device 5 is arranged within the housing 4, adjacent to the keyboard 2. However, the invention is not limited to such an arrangement. It is also possible to realize an electronic music instrument 1 with a controlling device 5 which is arranged in another position within the housing 4.

In this first embodiment of the invention, the two touch-sensitive means 6 are realized as two dual-touch capable touchstrips 6-1, 6-2 which are arranged adjacent towards one another and which are embedded within the housing 4. The two touchstrips 6-1, 6-2 are of an equal size and positioned next to each other. Moreover, in this first embodiment of the invention, via the first of the two touchstrips 6-1, a pitch of the output sound signals which can be triggered with the input elements 3, so the keys 3 of the keyboard 2 can be altered corresponding to the position of a marker which can be set with a touching gesture on the first touchstrip 6-1. Furthermore, via the second of the two touchstrips 6-2, a modulation of the output sound signals which can be triggered with the input elements 3, so with the keys 3 of the keyboard 2 can be altered corresponding to the position of a marker which can be set with a touching gesture on the second touchstrip 6-2. Expressed in other words, in this first embodiment of the invention, the first of the two alterable parameters is the pitch of an output sound signal, while the second of the two alterable parameters is the modulation of an output sound signal. However, the invention is not limited thereto. It is also possible to realize an electronic music instrument 1 with a controlling device 5 which comprises other touch-sensitive means 6 that comprise a sensor or a sensing unit which is adapted to sense a touching gesture of a user, e. g. at least one touch pad, at least one track pad, at least one display, at least one touchscreen or at least one other 2D-pad or display, e. g. an electro-wetting display or the like. Furthermore, it is possible to realize an electronic music instrument 1 with a controlling device 5 which comprises only one or more than two touch-sensitive means 6, for example three, four, five, six, seven, eight, nine, ten or even more than ten touch-sensitive means 6 which furthermore do not have to be realized as touchstrips 6-1, 6-2. For example, a controlling device 5 of an electronic music instrument 1 according to the invention can comprise three, four, five, six, seven, eight, nine, ten or even more than ten touchstrips 6-1, 6-2, which are arranged adjacent towards one another and wherein each touchstrip 6-1, 6-2 serves to alter at least one parameter of at least one output sound signal triggered with the input elements 3 respectively, wherein an alteration of a parameter is performable as described above. Furthermore, a parameter which is alterable with a touch-sensitive means 6 of a controlling device 5 of an electronic music instrument 1 according to the invention is not limited to the pitch or the modulation of an output sound signal. Other alterable parameters may be equal to any parameter of an output sound signal, for example the cut-off-frequency of a filter which is applied on the output sound signal, a wave-table position of an oscillator or any other, also instrument-specific parameter.

In order to change the pitch of certain output sound signals, the user of the electronic music instrument 1 has to press the respective input elements 3, the respective keys 3 of the keyboard 2 in order to trigger these certain output sound signals which he or she wants to alter regarding their pitch. Moreover, the user has to perform a touching gesture on the first touchstrip 6-1, thereby setting a marker on the touchstrip 6-1, wherein the relative position of the set marker determines the amount and the direction of the pitch alteration of the respective output sound signals. The touching gesture may be performed with one or more fingers of the left or right hand. This will be described with respect to FIGS. 2*a* to 4 hereinafter.

In this first embodiment of the invention, the touch-sensitive means 6, so the two touchstrips 6-1, 6-2, exemplarily are formed planar. However, it is also possible to realize electronic music instruments 1 with touch-sensitive means 6 which have a three-dimensional body or which at least are not planar. In this first embodiment, light emitting diodes 8 are arranged adjacent to the two touchstrips 6-1, 6-2 respectively, wherein a row of light emitting diodes 8 is arranged next to each touchstrip 6-1, 6-2, extending in a direction which is parallel to a long side of the respective touchstrip 6-1, 6-2. In this first embodiment, the light emitting diodes 8 are exemplarily adapted to emit light of two different colours respectively. Expressed in other words, the light emitting diodes 8 are adapted to emit light of a first colour and light of a second colour respectively, wherein the first colour is different from the second colour and wherein the light of the different colours can be emitted simultaneously or separately. However, it is also possible to realize other arrangements of such light emitting diodes 8, which also can be adapted to emit light of more than two different colours. In this first embodiment, the light emitting diodes 8 are adapted to visually indicate the amount and the direction of an alteration of the pitch and the modulation of output sound signals respectively. Expressed in other words, in this first embodiment of the invention, the light emitting diodes 8 are adapted to provide a visual feedback of an alteration of a parameter which will be further described with respect to FIG. 2 hereinafter. The controlling device 5 with the touch-sensitive means 6, so in this first embodiment of the invention with the two touchstrips 6-1, 6-2 is adapted to simulate physical systems. In this first embodiment of the invention, the controlling device 5 with the touch-sensitive means 6, so the two touchstrips 6-1, 6-2 is adapted to simulate a mechanical parameter control unit respectively. Expressed in other words, the controlling device 5 with the two touchstrips 6-1, 6-2 is exemplarily adapted to simulate the kinematics and/or the mechanical behaviour of the mechanical parameter control units, especially of mechanical parameter control units which are used in electronic keyboards of the state of the art. In more detail, in this first embodiment of the invention, using the first touchstrip 6-1, the controlling device 5 is exemplarily adapted to simulate different mechanical pitch control units, wherein by using the second touchstrip 6-2, the controlling device 5 exemplarily is adapted to simulate different mechanical modulation control units. Such simulatable mechanical parameter control units may comprise tactile wheel controls, physical spring systems and/or mechanical systems with loose components.

Furthermore, the light emitting diodes 8 which are arranged adjacent to the touchstrips 6-1, 6-2 are adapted to provide a visual feedback of an instant state of the simulated mechanical parameter control unit. Expressed in other words, the light emitting diodes 8 which are arranged adjacent to the touchstrips 6-1, 6-2 are adapted to indicate a current or instant position, a current or instant amplitude or a current or instant state of the mechanical parameter control unit respectively. Moreover, in this first embodiment of the invention, the touch-sensitive means 6, so the two touchstrips 6-1, 6-2 are each operable in different modes of operation. Expressed in other words, the behaviour and/or the functionality of the two touchstrips 6-1, 6-2 is variable, wherein in this first embodiment of the invention, a user can choose between a predefined set of different modes of operation. A first, second and third mode of operation is described with respect to the following figures.

Figure 2C:
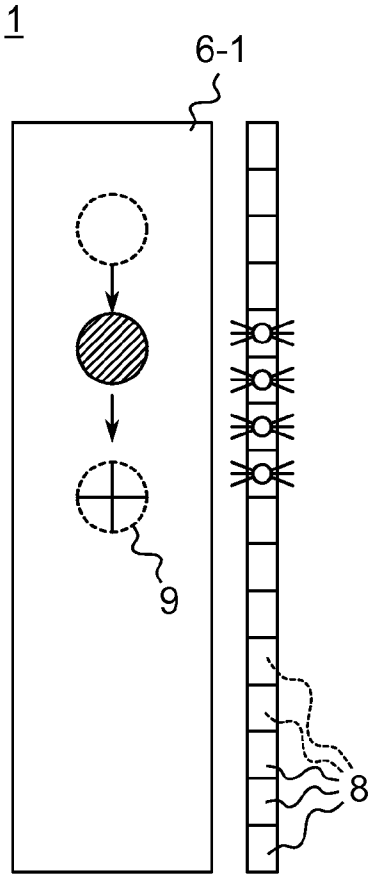
Figure 2B:
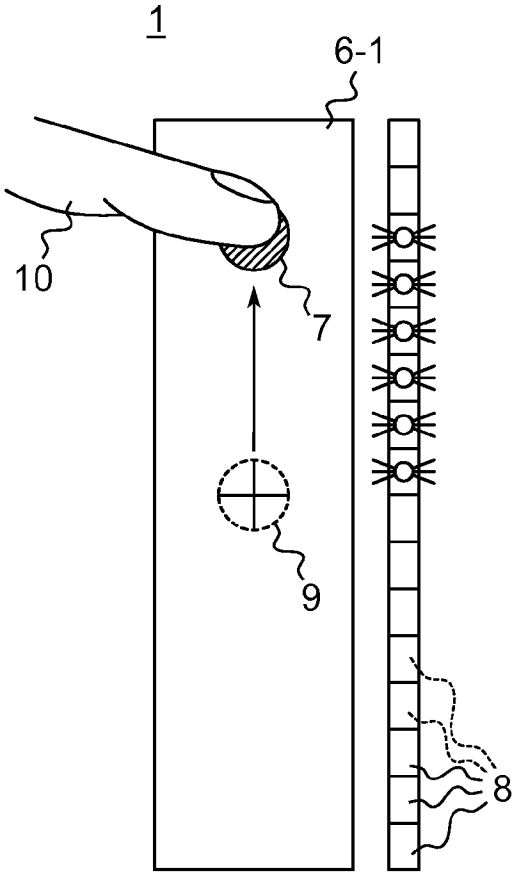
Figure 2A:
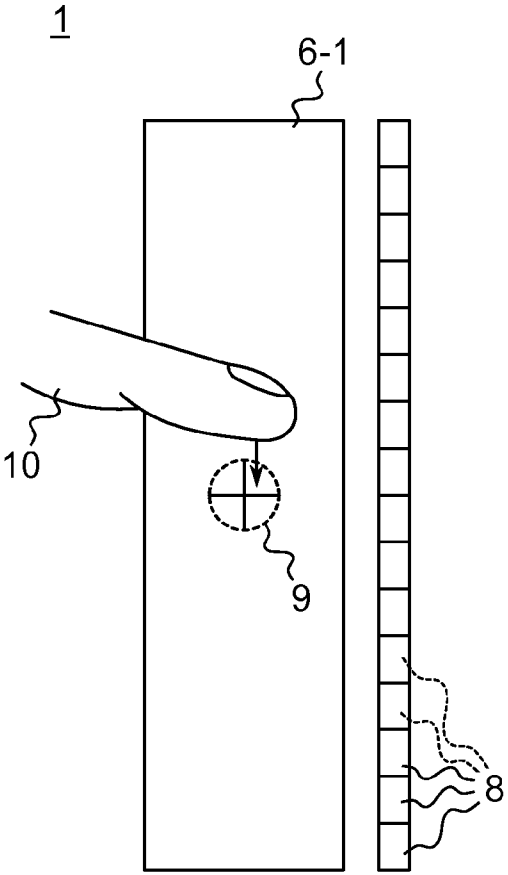

FIGS. 2*a*-2*c* show a schematic illustration of the functionality of the first touchstrip 6-1 of the first embodiment of an electronic music instrument 1 according to the invention in a first mode of operation. Expressed in other words, FIGS. 2*a*-2*c* show the functionality of the first touchstrip 6-1 in a first mode of operation, wherein a first stage of a possible operation is shown in FIG. 2*a* and a last stage of a possible operation is shown in FIG. 2*c*. In this first mode of operation, using the first touchstrip 6-1, the controlling device 5 is exemplarily adapted to simulate a spring system which comprises one spring. More precise, in this first mode of operation, via the first touchstrip 6-1, the controlling device 5 is exemplarily adapted to simulate a mechanical tactile wheel control for the control of a pitch of output sound signals which can be triggered with the input elements 3, so in this first embodiment with the keys 3 of the electronic keyboard 2. Such tactile wheel controls usually comprise a spring which on a first end is attached to a center position and which on a second end is attached to an inner wall of an at least partly rotatable wheel which is movably fixed within a housing. When such a tactile wheel control is actuated or turned into one direction, the pitch of an output sound signal alters according to the amount of the rotation of the tactile wheel control. When the tactile wheel control is released from this turned position, the spring arranged in it will force it back into a default position, realigning the first and the second end of the spring above one another. This is simulated within the first mode of operation.

In FIG. 2*a*, a virtual center position 9 within the first touchstrip 6-1 is predefined by a user. The user may determine this center position 9 depending on the desired direction and the desired amount of a potential alteration of the pitch of output sound signals. In FIG. 2*a*, the user exemplarily determined a center position 9 which is aligned with the actual geometrical center of the first touchstrip 6-1. This exemplarily enables the user to alter the pitch of an output sound signal upwards and downwards, so to increase and to decrease the pitch of an output sound signal depending on the respective touching gesture. In FIG. 2*a*, a finger 10 of a user is moved to the predefined virtual center position 9 of the first touchstrip 6-1. In this first embodiment of the invention and in the first mode of operation, the virtual center position 9 determines a zero baseline upon which the pitch of an output sound signal is not altered.

In this first embodiment of the invention, via the first touchstrip 6-1, the controlling device 5 is adapted to trace a sliding gesture along the first touchstrip 6-1. Consequently, in this first embodiment of the invention, using the first touchstrip 6-1, the controlling device 5 is adapted to continuously alter the pitch of output sound signals. In FIG. 2*b*, such a sliding gesture is denoted with an arrow. A marker 7 on the first touchstrip 6-1 is virtually generated in the position, in which the finger 10 touches the surface of the touchstrip 6-1. This marker 7 is moveable by sliding the finger 10 on the first touchstrip 9. The position of the marker 7 relative to the virtual center position 9 determines the amount and the direction of an alteration of a pitch of output sound signals. Therefore, in FIG. 2*b*, the pitch is exemplarily increased. The position of the marker 7 relative to the virtual center position 9 is indicated by light of a first colour of the light emitting diodes 8 which are arranged adjacent to the touchstrip 6-1. Since the pitch is altered according to the position of the marker 7, the light emitting diodes 8 also indicate the amount and the direction of the alteration of the pitch with light of a first colour, providing the user with a direct feedback about the current or instant amount and direction of an alteration of the pitch of an output sound signal. Expressed in other words, in this first mode of operation, the light emitting diodes 8 are adapted to visually indicate an instant virtual distance between the virtual marker 7 and the virtual center position 9, wherein the position of the virtual center position 9 is indicated with light of a second colour and wherein the instant virtual distance between the virtual marker 7 and the virtual center position 9 is indicated with light of a first colour.

In FIG. 2*c*, the finger 10 is released from the first touchstrip 6-1. Since in the first mode of operation of the first touchstrip 6-1, the controlling device 5 is adapted to simulate a spring system as used within a tactile wheel control via the first touchstrip 6-1, the marker 7 automatically moves back to the virtual center position 9 of the first touchstrip 6-1 upon a release of the first touchstrip 6-1, dragging the pitch back to the zero baseline, so to a zero level. Since the light emitting diodes 8 are virtually linked to the marker 7 or to the instant position of the marker 7, the amount of light emitting diodes 8 which are illuminating light of the first colour decreases according to the increasing proximity of the marker 7 to the virtual center position 9. When the marker 7 reaches the virtual center position 9, only the light emitting diodes 8 which indicate the virtual center position 9 remain illuminated. In this first embodiment of the invention, the flexibility of the spring of the simulated spring system is variable. Expressed in other words, in this first embodiment of the invention, the amount of time the marker 7 needs to return back to the virtual center position 9 when the finger 10 is released from the first touchstrip 6-1 is exemplarily predefinable or variable by a user. Furthermore, in this first embodiment of the invention, the state of the simulated physical system is alterable by a touching gesture on the at least one touch-sensitive means, wherein the marker 7 is virtually linked to the simulated physical system. Therefore, in this first embodiment and in this first mode of operation, it is also possible to alter the position of a marker 7 by directly touching the simulated spring of the spring system, virtually compressing or pulling the spring.

Figure 3:
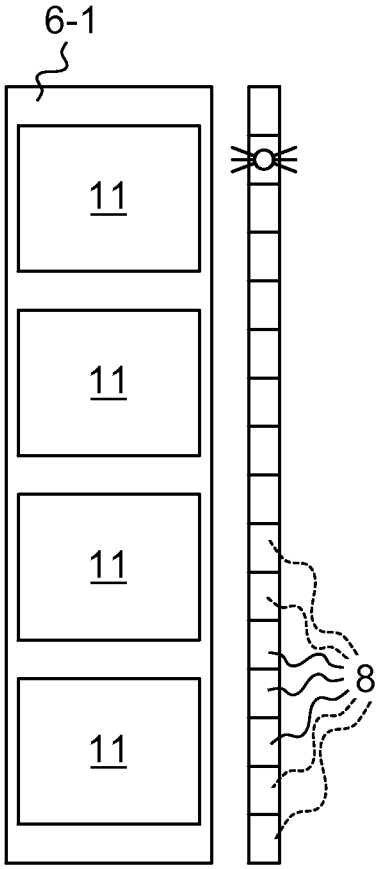

In FIG. 3, it is shown a schematic illustration of the functionality of the first touchstrip 6-1 of the first embodiment of an electronic music instrument 1 according to the invention in a second mode of operation. In this second mode of operation, the controlling device 5 is adapted to simulate a plurality of separate buttons 11 via first touchstrip 6-1, wherein each simulated button 11 is adapted to cause a change or an alteration in the pitch of output sound signals when touched. Expressed in other words, in this second mode, the first touchstrip 6-1 is divided into separate zones, each zone corresponding to a virtual button 11 that can be pressed via a touch gesture of a user. When a simulated button 11 is touched or pressed by a user, one of the plurality of light emitting diodes 8 which is arranged directly adjacent to the touched simulated button 11 is illuminated respectively, thereby indicating that the simulated button 11 is actuated. In this second mode of operation, each simulated button 11 exemplarily causes a discrete alteration of the pitch of the output sound signals. However, the invention is not limited thereto. Furthermore, it shall be noted that it is also possible to simulate more or less than four buttons 11 with the controlling device 5 using the first touchstrip 6-1, especially two, three or five buttons 11. Moreover, the simulated buttons 11 can be arranged in another pattern and can have another shape and a functionality that is different from the one as described hereinbefore. In other such embodiments of the invention, when a simulated button 11 is touched or pressed by a user, the light emitting diodes 8 which are arranged along the width of the respective pressed simulated button are adapted to emit light of a first colour respectively, wherein the light emitting diodes 8 which are arranged along the gaps between the simulated buttons 11 are adapted to emit light of a second colour.

Figure 4:
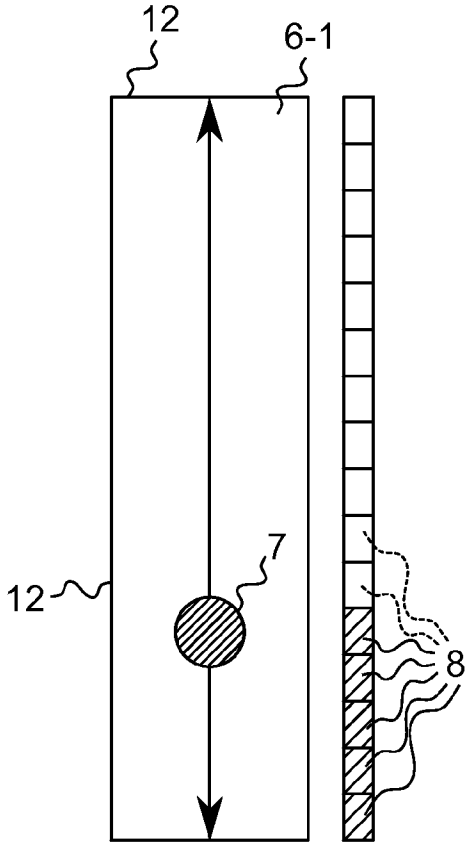

In FIG. 4, it is shown a schematic illustration of the functionality of the first touchstrip 6-1 of the first embodiment of an electronic music instrument 1 according to the invention in a third mode of operation. In this first embodiment, in the third mode of operation, the controlling device 5 is adapted to simulate a ball bouncing between at least two predefined borderlines of the first touchstrip 6-1, wherein the position of the marker 7 alters according to the movement of the simulated ball. In this first embodiment, in the third mode of operation, the predefined borderlines are exemplarily equal to the actual hardware frame 12 of the first touchstrip 6-1. However, it is also possible to predefine other borderlines for the simulated ball. The marker 7 which represents the simulated ball, bounces between these borderlines, wherein in this first embodiment of the invention, the bouncing of the marker 7 is exemplarily initiated with a sliding gesture of a user. For example, a user can virtually throw the simulated ball through moving his or her finger 10 on the first touchstrip 6-1. The pitch of triggered output sound signals alters according to the movement of the ball, wherein in this first embodiment, the lower predefined borderline is exemplarily set to a zero baseline. Therefore, in the moment in which the simulated ball or the marker 7 bounces against the lower predefined borderline, triggered output sound signals are not altered. In contrary, when the simulated ball or the marker 7 bounces against the upper predefined borderline, triggered output sound signals are maximally altered. The movement of the simulated ball or of the marker 7 is traced and visually indicated by the light emitting diodes 8 which are arranged adjacent to the first touchstrip 6-1. Expressed in other words, the light emitting diodes 8 are adapted to provide a visual feedback of a current position of the simulated ball or of the marker 7 with respect to the lower predefined borderline, so the zero baseline.

In this first embodiment of the invention, in the third mode of operation, the inertia and the mass of the simulated ball is predefinable. Expressed in other words, in this first embodiment, a user can vary and predefine the speed and the inertia of the ball, thereby altering the characteristics of a reaction of the simulated ball upon a sliding gesture on the first touchstrip 6-1. Since the simulated ball or the marker 7 oscillates between the predefined borderlines, the third mode of operation provides the user with a low or high frequency oscillator which is mapped to the pitch of the triggered output sound signals and which can be initiated via a sliding gesture on the first touchstrip 6-1.

In another mode of operation of the first touchstrip 6-1 of the first embodiment of the electronic music instrument 1 according to the invention, the simulated ball, so the marker 7 does not bounce against the upper predefined borderline, but passes it and disappears beyond it, reappearing at the lower predefined borderline. In a further such mode of operation the simulated ball is gravitated by the respective upper or lower predefined borderline, wherein the amount of gravitation is predefinable by a user. It is also possible to realize further modes of operation for the first touchstrip 6-1 which may differ from the modes of operation described hereinbefore.

It shall be noted that the description hereinbefore is directed to a pitch alteration via the first touchstrip 6-1. However, also the second touchstrip 6-2 can be operated in this first, second, third and further modes of operation, altering the modulation just as described hereinbefore with respect to the alteration of the pitch. In general, any touch-sensitive means 6 of a controlling device 5 can be operated in the first, second, third and further modes of operation as described hereinbefore, altering any parameter just as described before with respect to the alteration of the pitch.

In this first embodiment, the electronic music instrument 1 according to the invention replaces the standard control units of pitch, modulation and of other parameters, for example standard pitch and modulation wheel controls with dual-touch capable touchstrips. However, it is also possible to realize second and third embodiments which comprise other touch-sensitive means 6 which can be operated in other modes of operation which haven't been described hereinbefore.

In this first embodiment of the invention, the electronic music instrument 1 further comprises a player software with a plurality of play assistant modules and a collection of instrument plugins, wherein the keyboard 2, the player software with the plurality of play assistant modules and the collection of instrument plugins are adapted to directly communicate with each other in order to enable a deep level of integration between for example tangible hardware controllers as the keyboard 2 or the controlling device 5 and virtual software instruments.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

1 electronic music instrument
2 keyboard
3 input element, key(s)
4 housing
5 controlling device
6 touch-sensitive means
6-1 first touchstrip
6-2 second touchstrip
7 marker
8 light emitting diodes
9 center position
10 finger
11 simulated button
12 hardware frame

The invention claimed is:

1. An electronic music instrument, comprising at least one input element configured to trigger an output sound signal when pressed, the at least one input element comprising at least one of at least one key, at least one button, at least one knob, or at least one pad, the at least one element being a physical element;

a controlling device comprising at least one touch-sensitive means, wherein the touch-sensitive means is at least one touchstrip;

light emitting diodes; and a housing adapted to house the at least one input element, the controlling device, and the light emitting diodes;

wherein the controlling device is adapted to alter at least one parameter of at least one output sound signal triggered with the at least one input element corresponding to at least one marker, the controlling device being further adapted to set the position of the at least one marker by a simulation of a physical system, and wherein the state of the simulated physical system is alterable by a touching gesture on the at least one touch-sensitive means, wherein the light emitting diodes are arranged adjacent to the at least one touchstrip and are configured to indicate the amount and the direction of an alteration of the at least one parameter of the at least one output sound signal.

2. The electronic music instrument of claim 1, wherein the parameter is at least one out of the group comprising the pitch and the modulation of the at least one output sound signal.

3. The electronic music instrument of claim 1, wherein the physical system is a mechanical parameter control unit.

4. The electronic music instrument of claim 3, wherein light emitting diodes are arranged adjacent to the at least one touch-sensitive means, adapted to provide a visual feedback of an instant state of the simulated mechanical parameter control unit.

5. The electronic music instrument of claim 1, wherein the physical system is a spring system comprising at least one spring.

6. The electronic music instrument of claim 5, wherein the flexibility of the at least one spring is variable.

7. The electronic music instrument of claim 5, wherein the controlling device is adapted to trace a sliding gesture along the at least one touch-sensitive means.

8. The electronic music instrument of claim 1, wherein the controlling device is adapted to continuously alter the at least one parameter of the at least one output sound signal via a continuous touching gesture on the at least one touch-sensitive means.

9. The electronic music instrument of claim 8, wherein the at least one marker is adapted to spring back into a predefinable center position of the at least one touch-sensitive means upon release of the at least one touch-sensitive means.

10. The electronic music instrument of claim 1, wherein the at least one touch-sensitive means is subdivided to represent separate buttons, wherein each button is adapted to cause a change in the at least one parameter when touched.

11. The electronic music instrument of claim 10, wherein light emitting diodes are arranged adjacent to the at least one touch-sensitive means, adapted to provide a visual feedback when a simulated button is touched.

12. The electronic music instrument of claim 1, wherein the physical system is a ball bouncing between at least two predefinable borderlines on the at least one touch-sensitive means, wherein the at least one marker alters its position according to the simulated ball.

13. The electronic music instrument of claim 12, wherein light emitting diodes are arranged adjacent to the at least one touch-sensitive means, adapted to provide a visual feedback of a current position of the simulated ball.

14. The electronic music instrument of claim 12, wherein the inertia of the simulated ball is variable.

15. The electronic music instrument of claim 12, wherein the mass of the simulated ball is variable.

* * * * *